US005234442A

United States Patent [19]

Schäfer et al.

[11] Patent Number: 5,234,442

[45] Date of Patent: Aug. 10, 1993

[54] EPILATING APPLIANCE

[75] Inventors: Walter Schäfer, Frankfurt am Main; Hans-Eberhard Heintke, Wächtersbach; Gebhard Braun, Kelkheim, all of Fed. Rep. of Germany

[73] Assignee: Braun Aktiengesellschaft, Frankfurt, Fed. Rep. of Germany

[21] Appl. No.: 838,203

[22] PCT Filed: Aug. 23, 1990

[86] PCT No.: PCT/DE90/09642

§ 371 Date: Feb. 28, 1992

§ 102(e) Date: Feb. 28, 1992

[87] PCT Pub. No.: WO91/03964

PCT Pub. Date: Apr. 4, 1991

[30] Foreign Application Priority Data

Sep. 15, 1989 [DE] Fed. Rep. of Germany ..... 3930884

[51] Int. Cl.[5] ..... A61B 17/00

[52] U.S. Cl. ..... 606/133; 606/131

[58] Field of Search ..... 606/131, 133; 452/75, 452/102-104

[56] References Cited

U.S. PATENT DOCUMENTS

| | | | |
|---|---|---|---|
| 1,923,415 | 8/1933 | Bingham . | |
| 2,900,661 | 8/1959 | Schnell . | |
| 5,108,410 | 4/1992 | Iwasaki et al. | 606/133 |
| 5,112,341 | 5/1992 | Doley | 606/133 |

FOREIGN PATENT DOCUMENTS

| | | |
|---|---|---|
| 0147285 | 7/1985 | European Pat. Off. . |
| 0290120 | 11/1988 | European Pat. Off. . |
| 0328426 | 8/1989 | European Pat. Off. . |
| 1121291 | 1/1962 | Fed. Rep. of Germany . |
| 1017490 | 12/1952 | France . |
| 2556939 | 6/1985 | France . |
| 2563971 | 11/1985 | France . |
| 2626750 | 8/1989 | France . |

*Primary Examiner*—Stephen C. Pellegrino
*Assistant Examiner*—Glenn Dawson
*Attorney, Agent, or Firm*—Fish & Richardson

[57] ABSTRACT

The invention is directed to an epilating appliance, having a casing serving as a handle, a motor received in the casing, as well as a shaft carried in the casing and driven by the motor, the shaft having mounted thereon in a manner preventing relative rotation a set of circumferentially closed, relatively spaced circular disks arranged parallel to each other, and further having a casing opening exposing part of the circumference of the disks. The disks cooperate in pairs, each pair constituting a plucking device. On opposed faces of the disks, partial space-reducing means are provided. In the area between the motor and the shaft and parallel to the shaft, an axle is disposed in the casing having spreader rollers rotatably mounted thereon. The spreader rollers engage with part of their circumference in the space intermediate the disks of each plucking device.

16 Claims, 5 Drawing Sheets

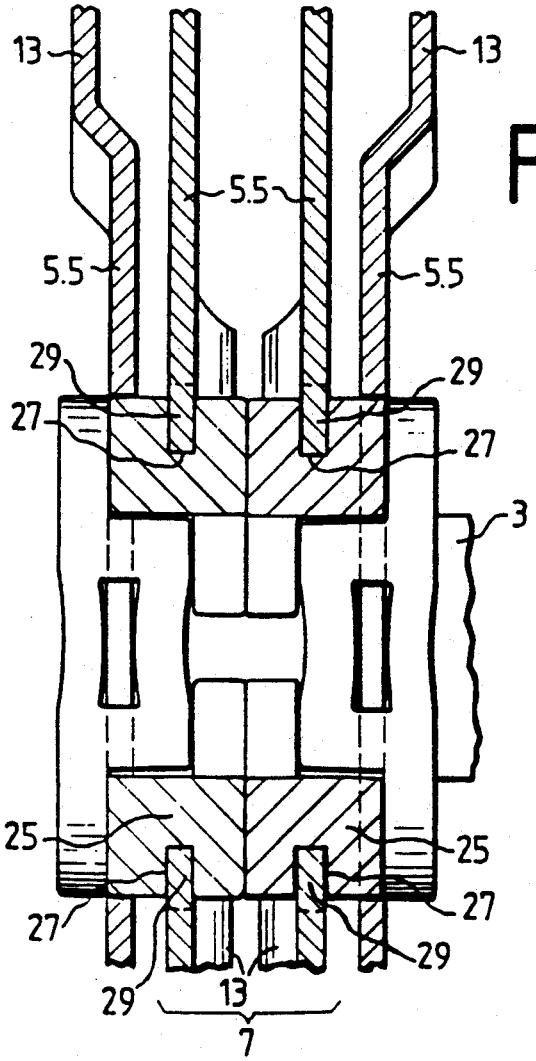
FIG.11
FIG.12
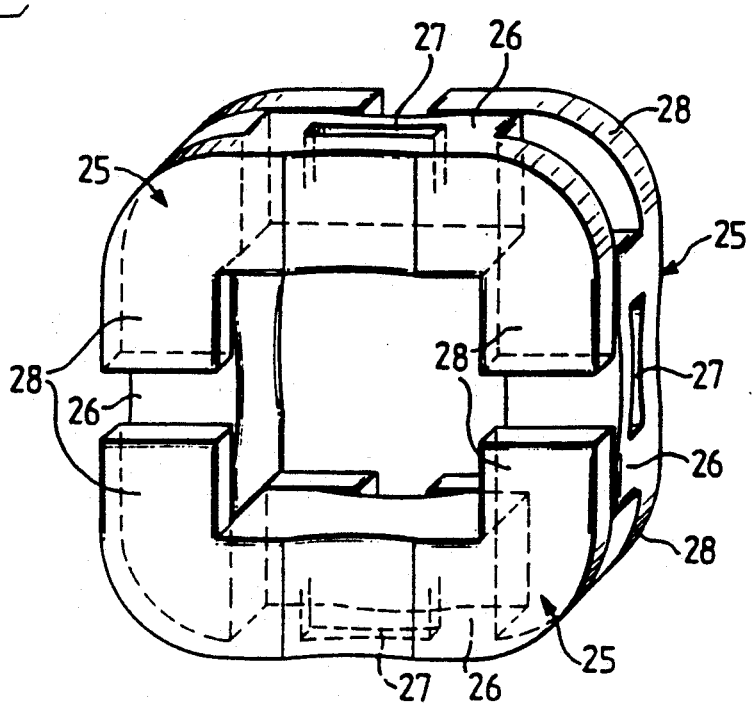

EPILATING APPLIANCE

This invention relates to an epilating appliance.

An appliance of the type initially referred to is known from EP-A-0 147 285. In this appliance, an axle provided with disks or brushes is arranged parallel to the driven shaft, the disks or brushes engaging with part of their circumference in the space intermediate the disks of the associated plucking members for the purpose of cleaning them.

Appliances of this type involve high constructional expenditure, necessitate a large number of individual components requiring manufacture to a high degree of precision, and have an unfavorable energy balance because of relatively high friction losses occurring in particular in the control of the tweezers action of the disks, which has an adverse effect particularly when operated from battery which is the preferred mode of operation of such hand-held small electrical appliances.

The advantage of the present invention resides for the one part in the use of a relatively small number of different components - the epilation head accordingly having a plurality of components which are identical in construction - and for the other part in reduced friction by the spreader rollers which at the same time act to clean the disks functioning as plucking members. In addition, the exclusive use of circumferentially closed circular disks relatively closely arranged in rows and serving as plucking members causes the skin to be held down during the plucking action.

A particularly advantageous, because simple and economical, construction of the appliance of the invention.

Another construction of the appliance of the invention affording greater advantages particularly in view of the energy balance, this construction being especially suited to speeding up the entire epilating process, because opening and closing of the disks under direct control of the spreader rollers permits several plucking operations to be executed during one disk revolution.

Also, particular embodiments include advantageous means for avoiding the exertion of special forces in particular during the closing cycle of the disks, and, naturally, for avoiding energy losses due to friction and additional holding and bending forces during the full opening cycle of the disks, while a straightforward construction is maintained.

Using in the area of the opening of the casing a comb known per se suitably engaging with its teeth between the disk pairs serves to support the skin and to locate the appliance in position during the plucking action.

Embodiments of the present invention are illustrated in the accompanying drawings. In the drawings, FIG. 1 is a schematic front elevational view of the epilating appliance with the casing opened;

FIG. 11 is another view, in section, of the assembly taken along the line 11—11 of FIG. 10;

FIG. 12 is a perspective view of the assembly illustrating the details of FIGS. 8 and 9.

Figure 1:
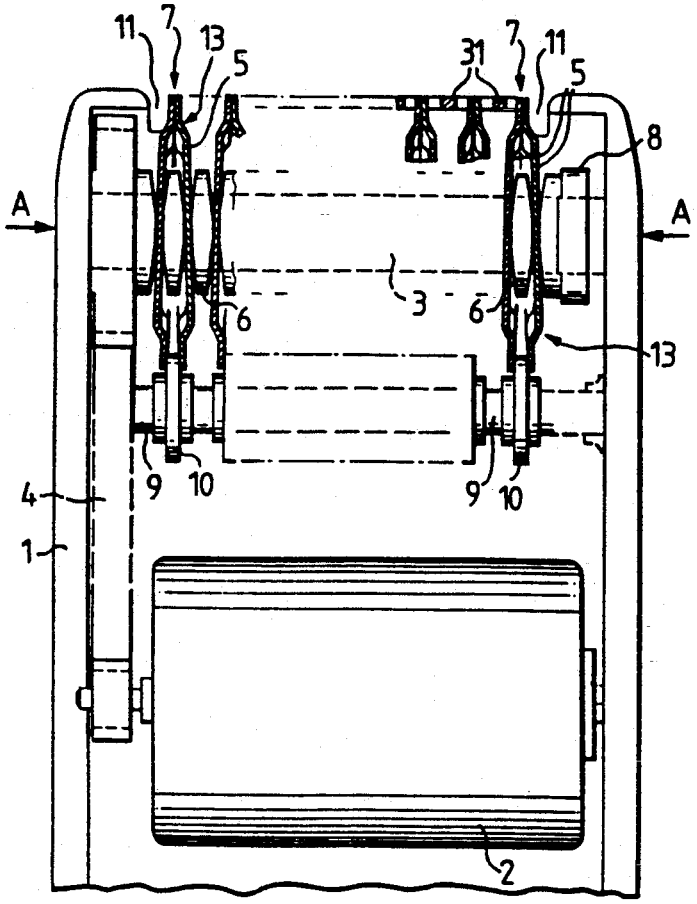
Figure 2:
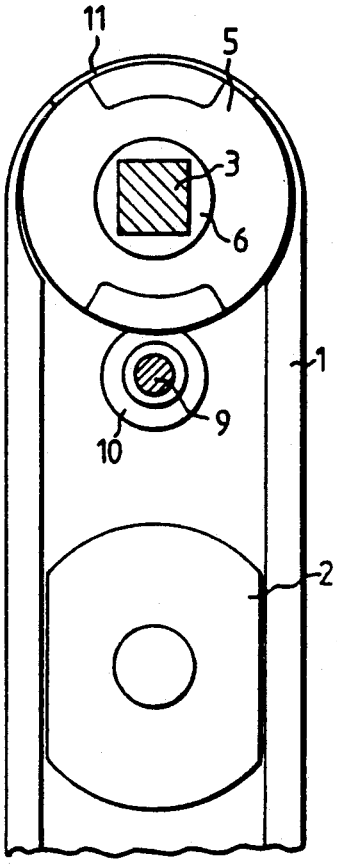
FIG. 2 is a side view thereof, showing a simplified representation partly in section.

Referring now to FIG. 1 of the drawings, there is shown an epilating appliance having a casing 1 serving as a handle and accommodating a motor 2 at its bottom end. At the opposite end of the casing 1, a shaft 3 is rotatably mounted, the shaft being driven by the motor 2 through a toothed belt 4. In lieu of a toothed belt, a train of gear-wheels or a simple belt as known per se may be used. The shaft 3 is of square cross section (FIG. 2). A row of circular, circumferentially closed disks 5 is disposed on the shaft 3, spacing rings 6 being provided to maintain the disks in a normal position at right angles to the shaft and at a predetermined relative distance; the disks 5 thus rotate with the shaft 3. The disks 5 cooperate in pairs to provide plucking devices 7 which, together with the spacing rings 6, are constrained by means of a nut 8 or the like in the longitudinal direction of the shaft 3, as indicated by arrows A. Fixedly mounted in the casing 1 in the area between the motor 2 and the shaft 3 and parallel to the shaft 3 is an axle 9 on which spreader rollers 10 rotate freely, part of their circumference engaging the space intermediate the disks 5 of a respective plucking device 7, as becomes apparent from FIGS. 1 and 2.

The set of disks 5 secured to the shaft 3 to form an assembly may be considered to be of a cylindrical configuration, part of the circumferential outer surface of the cylinder being accessible through an opening 11 provided in the casing 1 above the shaft 3, thus enabling the disks 5 to contact the skin.

Figure 3:
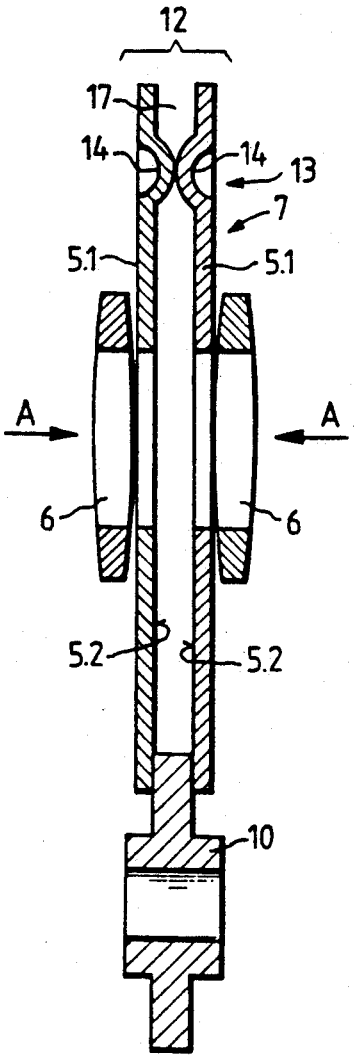
FIG. 3 is a schematic sectional view of a plucking device illustrating a first embodiment thereof.
Figure 4:
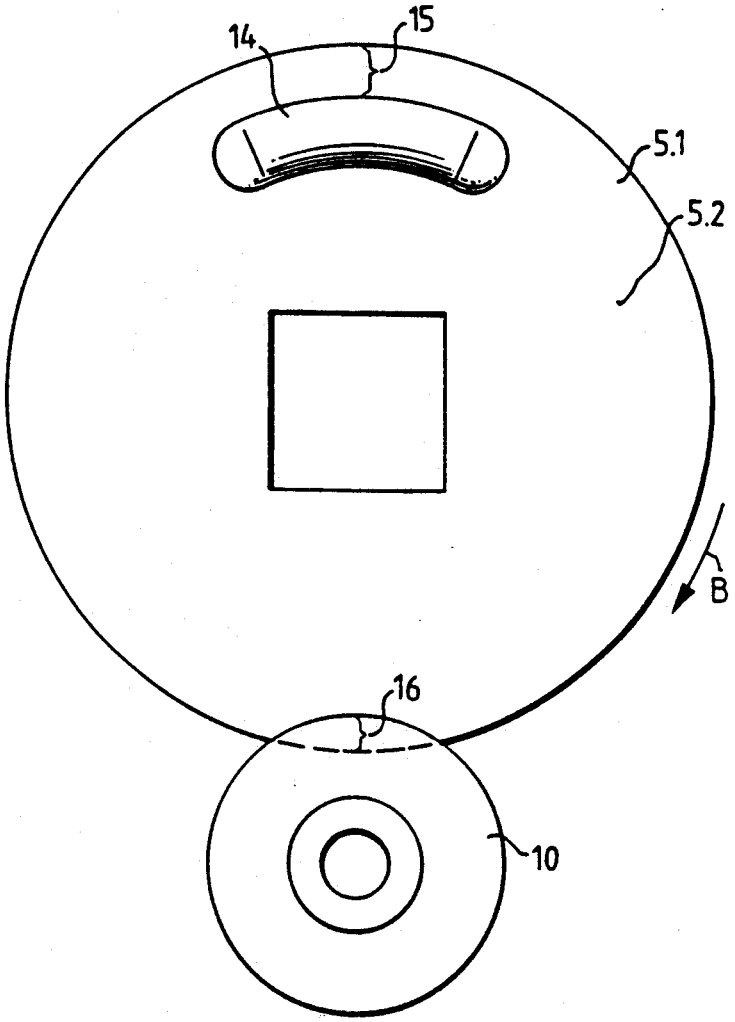
FIG. 4 is a front elevational view of the plucking device according to the embodiment of FIG. 3.

In the first embodiment of a plucking device 7 as shown in FIGS. 3 and 4, the disks 5.1 of the disk pair 12 have on opposed faces 5.2 space-reducing means 13 in the form of ribs 14 formed by embedded beads. The ribs 14 are curved, following the radius of the disks 5.1, the rib length being dimensioned to suit the desired closing period of each plucking device 7. The rib distance 15 from the disk periphery is greater than the engagement depth 16 of the associated spreader roller 10.

Under the pressure of the constraining force indicated by arrows A, the ribs 14 are in close relative engagement, while the spreader roller 10 keeps the disks 5.1 spaced apart at the opposite end. In this condition, which is shown in FIG. 3, the plucking device 7 is open to allow entrance of the hairs to be plucked. As the disks 5.1 continue rotating, the spreader roller 10 enters the free space 17 outside the ribs 14, the disks 5.1 tilt about the ribs 14 as about a link, and the diametrically opposite peripheral zones of the disks 5.1 are urged into mutual contact by the constraining force indicated by arrows A. This is then the closed position of the plucking device in which the hairs are gripped and trapped. In this closed position, on further rotation of the disks 5.1 the hairs are plucked out of the skin. The disks 5.1 and thus the plucking device 7 resume their open position as soon as the spreader roller 10 has left the space 17, enabling the disks 5.1 to tilt about the ribs 14 as about a link back into the position normal to the longitudinal direction of the shaft. In order not to impair the tilting motion of the disks 5.1, this embodiment of the plucking device 7 provides no spacing ring 6 between the disks 5.1 of the disk pair 12. In this embodiment, spacing rings 6 separate only adjacent disk pairs 12 successively disposed on the shaft 3, thereby maintaining a predetermined relative distance.

Figure 6:
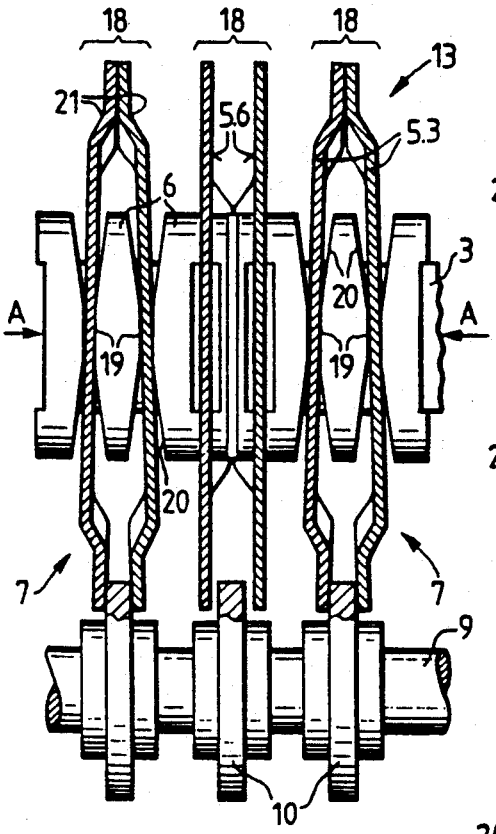
FIG. 6 is a schematic sectional view taken along the line 6—6 of FIG. 5.
Figure 5:
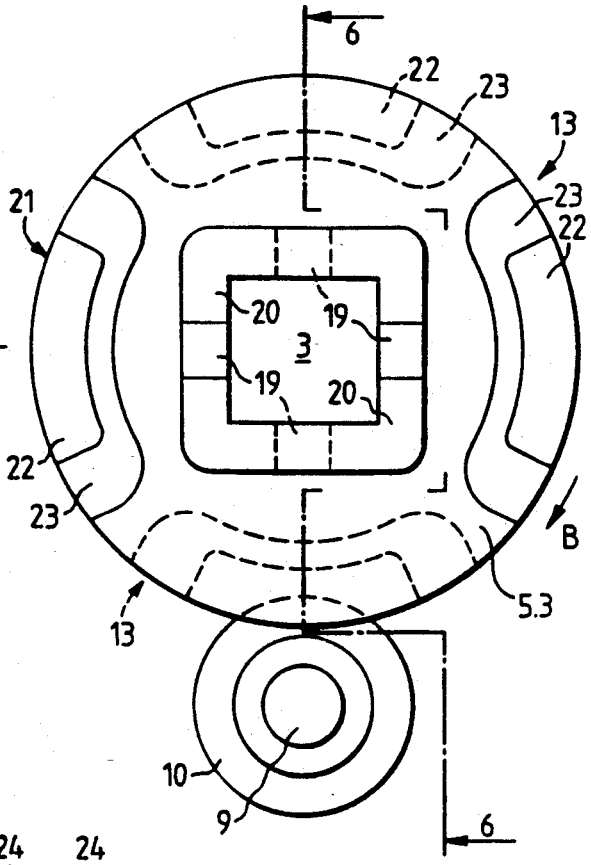
FIG. 5 is a schematic front elevational view of a plucking device illustrating a second embodiment thereof.
Figure 7:
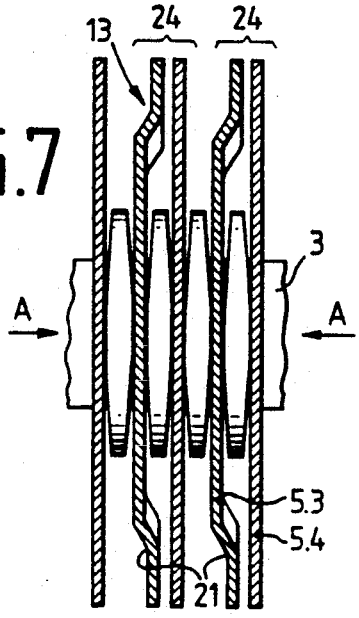
FIG. 7 is a view of a modified detail of the plucking device of FIGS. 5 and 6.
Figure 9:
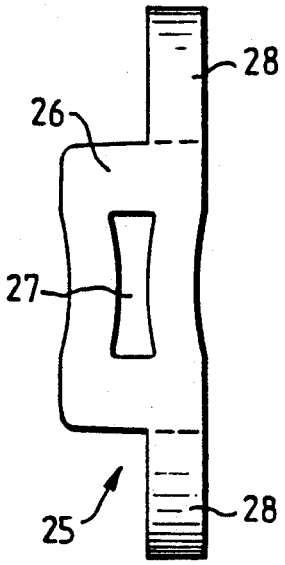
FIG. 9 is a top plan view of the plucking device of FIG. 8.
Figure 8:
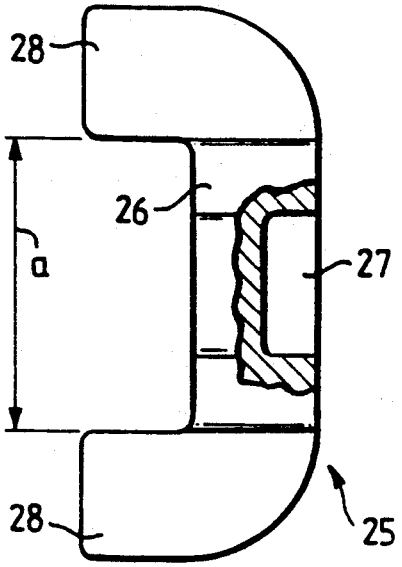
FIG. 8 is a side view of another modified detail of the plucking device of FIGS. 5 and 6.

In the embodiment of FIGS. 5 to 7, the disks 5.3 are again combined in disk pairs 18 forming a plucking device 7 each, the disks being slipped onto the shaft 3 of square cross-section and constrained by means of a nut 8, see arrows A, equally by means of spacing rings 6 which in this embodiment are additionally provided between the disks 5.3 of each disk pair 18. The spacing rings 6 have an inner plane area 19 ensuring that the disks 5.3 are in a position normal to the longitudinal direction when open, their peripheral area being partially beveled as at 20 to allow a deformation of the disks 5.3 by inclination towards the shaft 3.

Provided on at least one disk 5.3 of a disk pair 18 are two space-reducing means 13 disposed 180° apart and configured as embossed deformations 21 of a peripheral area of the disk 5.3, the means having a plane surface 22 which extends parallel to the disk inner face 5.6 and is provided with a respective ascending slope 23 both in and in opposition to the direction of rotation of the disk 5.3. The space-reducing means 13 are disposed 180° apart on each disk 5.3, lying opposite each other on either disk 5.3 of the disk pair 18.

The mode of operation of the epilating appliance is as follows: In the initial position of the plucking device 7, both disks 5.3 are in parallel arrangement, extending normal to the shaft 3. While the spreader roller 10 engages with part of its circumference in the space between the disks 5.3 of the associated disk pair 18, it has no or only little contact with the disks 5.3. In this position which becomes apparent from the center plucking device in FIG. 6, the plucking device 7 is open to allow the entrance of hairs. As the shaft 3 continues rotating with the disks 5.3, the spreader roller 10 associated with each plucking device 7 moves along the ascending slopes 23 and enters the area between the surfaces 22 of the space-reducing means 13, spreading both disks 5.3 of the disk pair 18 apart, such that the opposed surfaces 22 of the space-reducing means 13 spaced 180° apart abut each other under pressure—see the outer plucking device in FIG. 6—, grip the hair entered therein and pluck it out on further rotation of the shaft 3 or the disk 5.3. As the disk pair 18 continues rotating, causing the spreader roller to leave the area of the surfaces 22 and the slope which is now a descending slope, the disk pair 18 opens again to admit new hairs.

It is possible to speed up the plucking cycle of all plucking devices 7 significantly and thus reduce the overall operating time by disposing the space-reducing means 13 of adjacent disk pairs 18 in a 90° offset relation to each other, as shown in FIGS. 5 and 6. Particular economy of manufacture, parts storage and parts replacement is ensured because all essential components are of like construction, only the disks 5.3 requiring mounting in alternating directions.

In the embodiment of FIG. 7, only one disk 5.3 of each disk pair 24 is provided with embossed deformations 21 serving as space-reducing means 13 according to FIG. 5, the other disk 5.4 being of a plane configuration.

Figure 10:
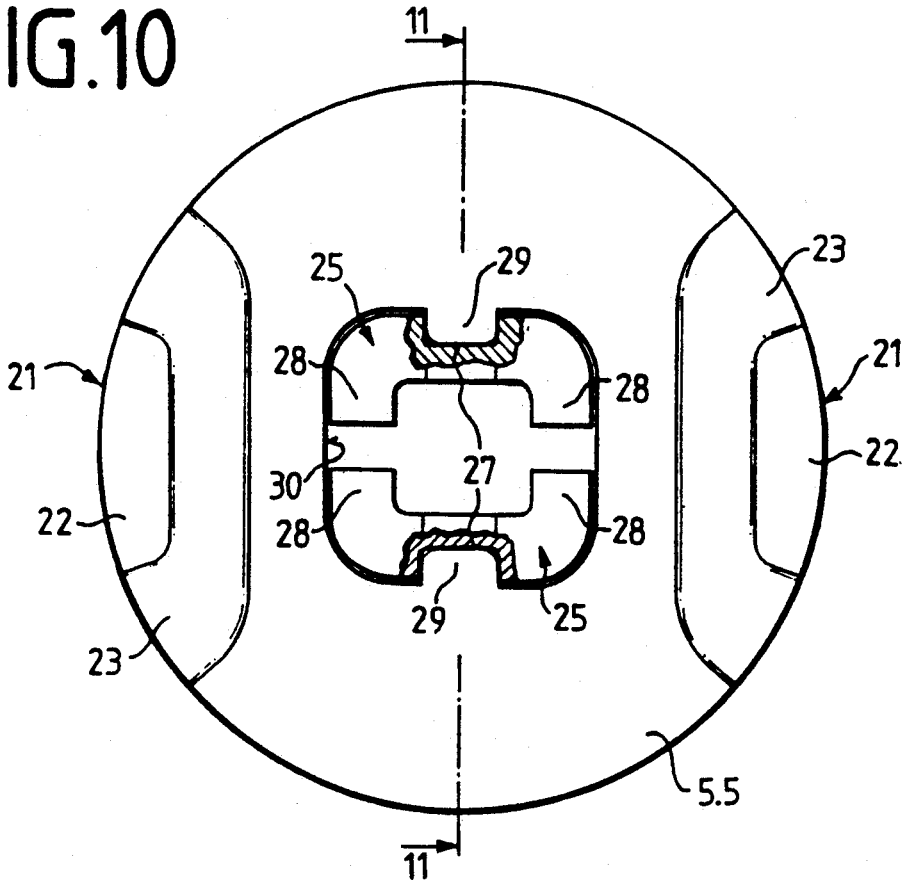
FIG. 10 is a front elevational view of an assembly comprising the plucking device of FIGS. 8 and 9.

FIGS. 8 to 12 illustrate a further highly advantageous modification of the mounting of the disks 5.5 of the plucking devices 7 by positive engagement with the shaft 3, in which the force to be exerted for spreading the disks can be reduced, resulting in reduced energy demands and wear while simplifying adjustment and eliminating problems that may be encountered under long-running conditions. The mounting is substantially comprised of bearing pads 25 shown in FIGS. 8 and 9 having in their central cuboid part 26 a pocket 27 and two arms 28 of reduced thickness protruding laterally at right angles, their relative distance a being dimensioned so as to enable the bearing pad 25 to be slipped onto the shaft 3 of square cross-section. As becomes apparent from FIG. 10, tabs 29 are provided extending from the inner cutout 30 of each disk 5.5, the cutouts being conformed to the outside dimensions of the bearing pads 25, and the tabs 29 being in turn conformed to the dimensions of the pockets 27. To mount the disks 5.5 on the shaft 3, a first step applicable to each disk involves slipping two bearing pads 25 with their pockets 27 onto the tabs 29, following which the resulting assembly shown in FIG. 10 is pushed onto the shaft 3. The respective dimensions are selected such that the tabs 29 fit relatively loosely and movably within the pockets 27 and that the disks 5.5 are tiltable relative to each other with ease, to the extent permitted by the spreader rollers 10 of FIG. 1 and necessary for the opening and closing of each pair of disks 5.5 constituting a plucking device 7. In this embodiment, the tabs 29 serve the function of trunnions about which the disks 5.5 are tilted when the ascending slopes 23 of their embossed deformations 21 and the associated surfaces 22 enter the area of the spreader rollers 10 in the course of rotation. Only when the opposed surfaces are in contact is an appreciable force required for spreading the disks 5.5 apart; however, this force requirement is only as high as necessary to securely grip and pluck the hairs. Additional holding and bending forces do not occur.

Owing to the special configuration of the bearing pads 25 as like parts adapted to be disposed in pairs in offset relation to each other, compact nesting of the plucking devices 7 with the desired 90° offset relation of the space-reducing means 13 is possible, as a result of which wide openings for the entrance of hairs and a minimum of inactive zones can be accomplished; the structure of the bearing pads 25 is uncritical in the presence of a minimum cumulative tolerance for the functionally important width of the gap between the disks 5.5, these relationships being shown in FIGS. 11 and 12, the nested assembly of the bearing pads 25 becoming particularly apparent from FIG. 12.

Figure 13:
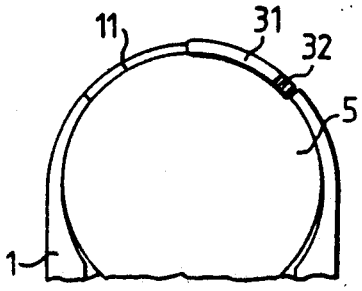
FIG. 13 is a fragmentary schematic view of a detail of the appliance of FIG. 1.

As FIG. 13 shows, a comb 32 may be provided in the opening 11 of the casing, the comb having teeth 31 engaging in the space intermediate the disk pairs 5 and serving as a hold-down device for supporting the skin as well as for locating the the appliance in position during the plucking action.

We claim:

1. An epilating appliance comprising a casing serving as a handle, a motor in said casing, a shaft in said casing and connected to said motor in driving relationship thereto, an axle fixedly mounted in said casing in the area between said motor and said shaft and parallel to said shaft, a plurality of spreader rollers mounted on said axle so as to rotate freely thereon, a plurality of circumferentially closed, relatively spaced circular disks arranged parallel to each other and mounted on said shaft for rotation therewith, said disks forming at least in part members of a plucking structure an opening in said casing exposing part of the circumference of said disks, said disks cooperating in pairs to provide plucking devices and provided with partial space-reducing means on opposed faces thereof, said spreader rollers being relatively spaced such that parts of their circumferences engage the spaces intermediate said disks of each said plucking device.

2. The appliance of claim 1 wherein said partial space-reducing means of each disk pair are configured as mutually contacting ribs provided between the disks of a disk pair, each said rib being curved and having a length dimensioned to correspond to a closing period of each said plucking device, and each said rib being spaced from the periphery of said disk at greater than the depth of engagement of said spreader rollers with said disks.

3. The appliance of claim 2 wherein said ribs are configured as beads embedded in said disks.

4. The appliance of claim 1 wherein said shaft is of square cross-section and has an axis, spacing rings mounted on said shaft between each disk pair, said spacing rings having on either side partial bevels, and said disk pairs and said spacing rings being constrained on said shaft in the direction of said axis of said shaft.

5. The appliance of claim 4 wherein said partial space-reducing means of each disk pair are configured as mutually contacting ribs provided between the disks of a disk pair, each said rib being curved and having a length dimensioned to correspond to a closing period of each plucking device, and each said rib being spaced from the periphery of said disk at greater than the depth of engagement of said spreader rollers with said disks.

6. The appliance of claim 1 wherein two space-reducing means are provided disposed 180° apart on an inner face of at least one disk of a disk pair.

7. The appliance of any one of claims 1–6 wherein said space-reducing means are configured as embossed deformations of peripheral areas of said disks, such that an essential part of said deformations has a plane surface extending parallel to the faces of said disks.

8. The appliance of any one of claims 1–6 wherein the disks have elastic properties, said elastic properties and the diameter of said disks are such that on engagement of said spreader rollers in the space intermediate surfaces of said space-reducing means of a disk pair, the diametrically opposed surfaces of associated space-reducing means abut each other under pressure.

9. The appliance of any one of claims 1–6 wherein surfaces of said partial space-reducing means are provided with an ascending slope at least in the direction of rotation of said shaft (arrow B).

10. The appliance of any one of claims 1–6 and further including comb structure arranged in said casing opening, said comb structure having teeth engaging in the space intermediate pairs of said disks.

11. The appliance of claim 1 wherein said partial space-reducing means of a disk pair are disposed in offset relation to those of adjacent disk pairs in the direction of rotation of said shaft.

12. The appliance of claim 11 wherein the amount of said offset relation is 90°.

13. The appliance of claim 1 and further including bearing pad structure for mounting said disks on said shaft in a non-rotating relationship thereto, said disks being carried by said bearing pad structure for positive engagement therewith, yet tiltable towards adjacent disks.

14. The appliance of claim 13 wherein each said disk has an aperture for said shaft and each said aperture includes tab portions for receiving said bearing pad structure.

15. The appliance of claim 13 or 14 wherein said bearing pad structure comprises a series of interlocking pairs of bearing pads, each pair of bearing pads being associated with each said disk pair.

16. The appliance of claim 15 wherein said pairs of bearing pads are adapted to nest in a 90° offset relation to each other in the axial direction of said shaft.

* * * * *